US009407993B2

(12) United States Patent
Ekstrand

(10) Patent No.: US 9,407,993 B2
(45) Date of Patent: Aug. 2, 2016

(54) LATENCY REDUCTION IN TRANSPOSER-BASED VIRTUAL BASS SYSTEMS

(71) Applicant: DOLBY INTERNATIONAL AB, Amsterdam Zuidoost (NL)

(72) Inventor: Per Ekstrand, Saltsjobaden (SE)

(73) Assignee: Dolby International AB, Amsterdam Zuidoost (NL)

( * ) Notice: Subject to any disclaimer, the term of this patent is extended or adjusted under 35 U.S.C. 154(b) by 0 days.

(21) Appl. No.: 14/433,983

(22) PCT Filed: Sep. 27, 2013

(86) PCT No.: PCT/EP2013/070262

§ 371 (c)(1),
(2) Date: Apr. 7, 2015

(87) PCT Pub. No.: WO2014/060204

PCT Pub. Date: Apr. 24, 2014

(65) Prior Publication Data

US 2015/0312676 A1 Oct. 29, 2015

Related U.S. Application Data

(63) Continuation of application No. 13/652,023, filed on Oct. 15, 2012, now Pat. No. 8,971,551, which is a continuation-in-part of application No. 12/881,821, filed on Sep. 14, 2010, now Pat. No. 9,236,061, said (Continued)

(51) Int. Cl.
*H04R 3/04* (2006.01)
*G10H 1/16* (2006.01)

(Continued)

(52) U.S. Cl.
CPC .. *H04R 3/04* (2013.01); *G10H 1/16* (2013.01); *G10H 1/20* (2013.01); *G10L 21/038* (2013.01);

(Continued)

(58) Field of Classification Search
None
See application file for complete search history.

(56) References Cited

U.S. PATENT DOCUMENTS

| | | | |
|---|---|---|---|
| 8,971,551 | B2 | 3/2015 | Ekstrand |
| 8,983,852 | B2 | 3/2015 | Ekstrand |
| 2012/0008788 | A1 | 1/2012 | Jonsson |

FOREIGN PATENT DOCUMENTS

| | | |
|---|---|---|
| JP | 2009-244650 | 10/2009 |
| JP | 2011-125004 | 6/2011 |

(Continued)

OTHER PUBLICATIONS

Florencio, D. "On the Use of Asymmetric Windows for Reducing the Time Delay in Real-Time Spectral Analysis" International Conference on Acoustics, Speech & Signal Processing, New York, USA, vol. 16, Apr. 14, 1991, pp. 3261-3264.

*Primary Examiner* — Paul Huber
(74) *Attorney, Agent, or Firm* — Dennis John Duncan; Geoffrey Staniford

(57) ABSTRACT

A latency reduction system in a virtual bass processing system performs harmonic transposition on low frequency components of an audio signal to generate transposed data indicative of harmonics of the audio signal. The system uses a base transposition factor greater than two, and generates the harmonics in response to frequency-domain values determined by forward and inverse transform stages that use asymmetric analysis and synthesis windows. The system combines a virtual bass signal with the delayed wide band audio signal through analysis filter banks having filter coefficient truncated Nyquist filters. The virtual bass signal may lag the delayed wide band audio signal when combining with the audio signal to further reduce the latency caused by the harmonic transposition. The virtual bass input signal may be directly routed from a CQMF analysis filter bank of a preceding Hybrid filter bank stage, in order to avoid the delay associated with a Nyquist filter bank.

22 Claims, 10 Drawing Sheets

Related U.S. Application Data application No. 13/652,023 is a continuation-in-part of application No. 13/321,910, filed as application No. PCT/EP2010/057176 on May 25, 2010, now Pat. No. 8,983,852, said application No. 13/652,023 is a continuation-in-part of application No. 13/499,893, filed as application No. PCT/EP2010/057156 on May 25, 2010, now Pat. No. 8,886,346.

(60) Provisional application No. 61/243,624, filed on Sep. 18, 2009, provisional application No. 61/181,364, filed on May 27, 2009, provisional application No. 61/312,107, filed on Mar. 9, 2010, provisional application No. 61/253,775, filed on Oct. 21, 2009, provisional application No. 61/330,786, filed on May 3, 2010.

(51) Int. Cl.
*G10H 1/20* (2006.01)
*G10L 21/038* (2013.01)
*H04R 1/22* (2006.01)

(52) U.S. Cl.
CPC ..... *H04R 1/22* (2013.01); *G10H 2210/245* (2013.01); *G10H 2250/235* (2013.01); *H04R 2430/03* (2013.01)

(56) References Cited

FOREIGN PATENT DOCUMENTS

| | | |
|---|---|---|
| JP | 2011-133906 | 7/2011 |
| JP | 2012-515362 | 7/2012 |
| JP | 2012-150507 | 8/2012 |
| JP | 2012-524440 | 10/2012 |
| JP | 2013-531265 | 8/2013 |
| WO | 2013/124443 | 8/2013 |

Table 1

| L B | 2 | 4 | 8 | 16 |
|---|---|---|---|---|
| 16 | 512 | 384 | 320 | 288 |
| 32 | 1280 | 1024 | 896 | 832 |
| 41 | 1712 | 1384 | 1220 | 1138 |
| 64 | 2816 | 2304 | **2048** | 1920 |
| 128 | 5888 | 4864 | 4352 | 4096 |

Table 2

| L B | 2 | 4 | 8 | 16 |
|---|---|---|---|---|
| 16 | 640 | 512 | 448 | 416 |
| 32 | 1408 | 1152 | 1024 | 960 |
| 41 | 1840 | 1512 | 1348 | 1266 |
| 64 | 2944 | 2432 | **2176** | 2048 |
| 128 | 6016 | 4992 | 4480 | 4224 |

Table 3

| D B | 2 | 4 | 8 | 16 |
|---|---|---|---|---|
| 15 | 528 | 408 | 348 | 318 |
| 31 | 1296 | 1048 | 924 | 862 |
| 40 | 1728 | 1408 | 1248 | 1168 |
| 63 | 2832 | 2328 | **2076** | 1950 |
| 127 | 5904 | 4888 | 4380 | 4126 |

Table 4

| D B | 2 | 4 | 8 | 16 |
|---|---|---|---|---|
| 15 | 656 | 536 | 476 | 446 |
| 31 | 1424 | 1176 | 1052 | 990 |
| 40 | 1856 | 1536 | 1376 | 1296 |
| 63 | 2960 | 2456 | **2204** | 2078 |
| 127 | 6032 | 5016 | 4508 | 4254 |

LATENCY REDUCTION IN TRANSPOSER-BASED VIRTUAL BASS SYSTEMS

CROSS-REFERENCE TO RELATED APPLICATIONS

This application claims priority to U.S. Provisional patent application Ser. No. 13/652,023 filed 15 Oct. 2012, which is hereby incorporated by reference in its entirety

TECHNICAL FIELD

One or more embodiments relate generally to transform-based audio signal processing, and more specifically to reducing latency in transposer-based virtual bass synthesis systems.

BACKGROUND

Bass synthesis refers to methods of adding components to the low frequency range of a signal in order to enhance the perceived bass. Of these methods, a sub-bass synthesis technique creates low frequency components below the existing partials of a signal in order to extend and improve the lowest frequency range present in the subject audio content. Another method uses virtual pitch algorithms that generate audible harmonics from an inaudible bass range (e.g., low pitched bass played through small loudspeakers), hence making the harmonics, and ultimately also the pitch, audible in order to improve the bass response.

Virtual bass synthesis is a virtual pitch method that increases the perceived level of bass content in audio when played on small loudspeakers that cannot physically reproduce the low-end bass frequencies. The method is based on the 'missing fundamental' psycho-acoustic observation that low pitches can be inferred by the human auditory system from upper harmonics even when the fundamental and the first harmonics themselves are missing. The basic method of functionality is to analyze the bass frequencies present in the audio and generate audible upper harmonics that aid the perception of the missing lower frequencies. A main feature of virtual bass is that it enhances the perceived bass response on devices with small speakers by synthesizing upper harmonics for frequencies below the low-frequency roll-off of the device (e.g., below 150 Hz). Inaudible signal components are transposed to higher audible frequencies using plural transposition factors (harmonics), followed by energy adjustment. Virtual bass synthesis may also increase the perceived bass for headphone playback or playback on full-range loudspeakers. FIG. 1A shows the frequency-amplitude spectrum of an audio signal having an inaudible range 10 of frequency components, and an audible range of frequency components above the inaudible range. Harmonic transposition of frequency components in the inaudible range 10 can generate transposed frequency components in portion 11 of the audible range, which can enhance the perceived level of bass content of the audio signal during playback. Such harmonic transposition may include application of multiple transposition factors to each relevant frequency component of the input audio signal to generate multiple harmonics of the component.

In certain audio processing systems that utilize legacy virtual bass systems, the delay or latency associated with the frequency transposition function can be excessive for certain applications. For example, a digital audio processing system that has a latency of 1025 samples may use a legacy virtual bass system that adds an additional 3200 samples of delay.

This can cause a total delay to exceed 88 milliseconds, given a sampling frequency ($f_s$) of 48 kHz. This amount of latency is generally problematic and even prohibitive for gaming and telecommunications applications, where a latency of about 100 milliseconds starts to become noticeable in terms of audible signal delay.

Traditional transposer systems used in legacy virtual bass systems use symmetric time domain windows for the analysis and synthesis stages of the time-to-frequency and frequency-to-time transforms respectively. FIG. 1B illustrates the delay associated with symmetric windows used in legacy virtual bass systems, as known in the prior art. FIG. 1B graphically illustrates the delay imposed by a second-order transposer, i.e., a transposer that generates $2^{nd}$ order harmonics. As shown in time plot 100, the center of one of the stylistic symmetric analysis window is chosen as the time zero reference, and new input samples 104 can be added from time $t_0$ in the analysis phase 102, assuming a time stride $S_A$ of the analysis windows. Time plot 110 shows the time stretch duality of the transposer, where to is stretched to $2 \cdot t_0$ in the synthesis phase 112.

The total analysis/synthesis chain delay, $D_{ts}$, for the example process shown in FIG. 1B, where L is the transposer window size, and $S_A$ is the analysis time stride or hop-size can be expressed as follows in Eq. 1 below:

$$D_{ts}=L/2+2\cdot(L/2-S_A)=3\cdot L/2-2\cdot S_A \quad \text{(Eq. 1)}$$

In a HQMF (Hybrid Quadrature Mirror Filter) bank based audio processing system, the input signal to the CQMF (Complex Quadrature Mirror Filter) analysis stage and the output signal from the CQMF synthesis stage generally both have the same sampling frequency $f_s$, where $f_s$ is usually set to 44.1 or 48 kHz. The input signal sampling rate to the virtual bass process may be $f_s/64$ since the system is usually processing the first CQMF signal only from a 64-channel CQMF bank. It should be noted that CQMF sizes other than 64 channels could also be used. The transposed output from the legacy virtual bass processing system has a sampling frequency of $2 \cdot f_s/64$ because of the combined transposition function using a factor two base transposition factor, resulting in a factor two bandwidth expansion. In a combined transposer, the base transposition factor is the factor where the source transform bins (or frequency bands) are mapped in a one-to-one relationship to the target transform bins (or frequency bands), i.e., there is no interpolation or decimation involved in the source to target bin mapping. The base transposition factor also governs the relation between the time strides of the analysis and synthesis windows. More specifically, the synthesis time stride equals the analysis time stride multiplied by the base transposition factor. The delay in output samples from a 64-channel CQMF based system for a case in which L=64 and $S_A$=4, becomes:

$$D_{ts}=\{3L/2-2\cdot S_A\}\cdot 64/2=2816 \text{ samples} \quad \text{(Eq. 2)}$$

In addition to this delay, a delay from the Nyquist filter bank analysis stage processing of the two virtual bass output CQMF sub-band signals is added. This delay may be on the order of 384 samples, thus giving a total delay of 2816+384=3200 samples for this example prior art legacy virtual bass processing system.

One solution to the latency imposed by legacy virtual bass systems is to change the actual processing circuitry, such as the harmonic generator, such as by replacing the harmonic transposer with alternative components. However, this potentially adds a great deal of cost and complexity to the system and may also negatively impact the audio quality.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF EMBODIMENTS

Embodiments include a latency reduction system in a virtual bass processing system that performs harmonic transposition on low frequency components of an audio signal to generate transposed data indicative of harmonics. The harmonic transposition process uses a base transposition factor greater than two, and generates the harmonics in response to frequency-domain values determined by transform and inverse transform stages that use asymmetric analysis and synthesis windows. An enhanced audio signal is generated by combining a virtual bass signal with the delayed audio signal through the use of Nyquist analysis filter banks that comprise truncated prototype filters. The virtual bass signal may be allowed to lag the delayed audio signal by a defined time period when combining with the audio signal to further reduce the latency caused by the harmonic transposition process.

Embodiments include a method of reducing latency in a virtual bass generation system by performing harmonic transposition on low frequency components of an input audio signal to generate transposed data indicative of harmonics, wherein the harmonic transposition uses a base transposition factor of an integer value greater than two. It generates the harmonics in response to frequency-domain values determined by a time-to-frequency domain transform stage and a subsequent inverse frequency-to-time domain transform stage through the use of asymmetric analysis and synthesis windows for the time-to-frequency domain transform and inverse frequency-to-time domain transforms. The input audio signal is a sub-banded CQMF (complex-valued quadrature mirror filter) signal and samples of the input audio signal may be pre-processed to generate critically sampled audio indicative of the low frequency components.

In an embodiment, the method processes the input audio signal through an analysis filter bank or transform to provide a set of analysis sub-band signals or frequency bins from the low frequency components, computes a set of synthesis sub-band signals or frequency bins using the base transposition factor B and transposition factor T, and processes the analysis sub-band signals or frequency bins through a synthesis filter bank or transform to generate a high frequency component from the set of synthesis sub-band signals. This represents a standard way of doing transposition, i.e., performing forward FFT transforms followed by non-linear processing including transform bin mapping, and then performing inverse FFT transforms. The method may further include generating a virtual bass signal in response to the transposed data, and generating an enhanced audio signal by combining the virtual bass signal with the input audio signal by applying one or two analysis filter banks to the virtual bass audio output signal, wherein the analysis filter banks comprise truncated prototype filters that have a defined number of filter coefficients removed. The method may yet further include a lag of the virtual bass signal by a pre-defined time period relative to the input audio signal, by combining the virtual bass signal with the input audio signal delayed a pre-defined time period shorter than the processing delay of the virtual bass system would imply, to generate an enhanced audio signal comprising time lagged virtual bass processed sub-band samples combined with delayed input sub-band samples.

The base transposition factor under some embodiments extends the input audio signal in the frequency domain to a degree proportionate to the value of the base transposition factor to produce a transposed audio signal, and this base transposition factor may be an even integer value between 4 and 16. In an embodiment, the analysis filter banks operating on the transposer CQMF output sub bands comprise an eight-channel Nyquist filter bank and a four-channel Nyquist filter bank, and the defined number of removed prototype filter coefficients comprises six coefficients. In a further embodiment, the input CQMF signal is routed directly from a preceding CQMF analysis bank channel 0 output, hence bypassing a subsequent Nyquist filter bank stage and so avoiding the related delay.

Embodiments of the method may further include generating the low frequency components by performing a frequency domain oversampled transform on the input audio signal by generating windowed and zero-padded samples at a defined sample frequency (using the analysis time stride). The predefined time period when combining the virtual bass signal with the delayed input audio signal may be a value selected from the range of 0 samples to 1000 samples, since the virtual bass signal may be allowed to lag the wide band input audio signal up to 20 ms without noticeable degradation of the enhanced audio signal. In an embodiment, the asymmetric analysis and synthesis windows are configured such that a longer portion of the analysis windows are stretched toward past input samples, and that a longer portion of the synthesis windows are stretched toward future output samples.

Embodiments are also directed to systems or apparatus elements configured to implement at least some of the methods described above.

BRIEF DESCRIPTION OF THE DRAWINGS

In the following drawings like reference numbers are used to refer to like elements. Although the following figures depict various examples, the one or more implementations are not limited to the examples depicted in the figures.

DETAILED DESCRIPTION

Figure 1A:
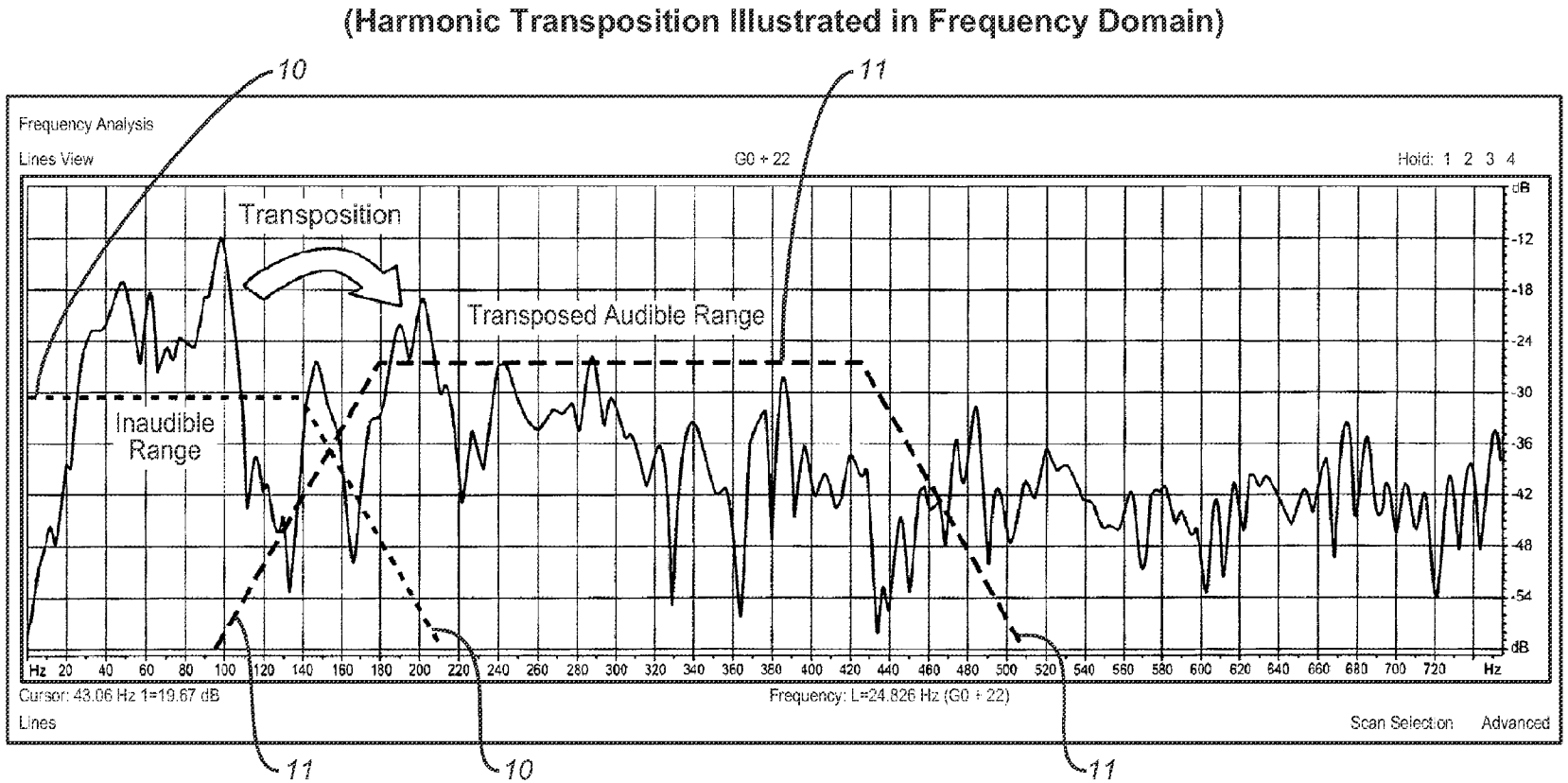
FIG. 1A (PRIOR ART)
FIG. 1A illustrates the transposition of frequency components from an inaudible frequency range to an audible frequency range in a known virtual bass processing system.

Embodiments of systems and methods are described for reducing latency and algorithmic delays in transposer-based virtual bass systems. Such systems and methods utilize higher-order base transposition factors, low latency asymmetric transform windows, truncated Nyquist prototype filters, a time lagged virtual bass signal in respect to the original audio signal, and a bypassed Nyquist analysis filter bank in a preceding Hybrid filter bank stage.

Throughout this disclosure, including in the claims, the expression performing an operation "on" a signal or data (e.g., filtering, scaling, transforming, or applying gain to, the signal or data) is used in a broad sense to denote performing the operation directly on the signal or data, or on a processed version of the signal or data (e.g., on a version of the signal that has undergone preliminary filtering or pre-processing prior to performance of the operation thereon). The expression "transposer" is used in a broad sense to denote an algorithmic unit or device that performs pitch-shifting or time-stretching of a real or complex-valued input signal, for parts of, or the entire available input signal spectrum. The expressions "transposer", "harmonic transposer", "phase vocoder", "high frequency generator" or "harmonic generator" may be used interchangeably. The expression "system" is used in a broad sense to denote a device, system, or subsystem. For example, a subsystem that implements a decoder may be referred to as a decoder system, and a system including such a subsystem (e.g., a system that generates X output signals in response to multiple inputs, in which the subsystem generates M of the inputs and the other X-M inputs are received from an external source) may also be referred to as a decoder system. The term "processor" is used in a broad sense to denote a system or device programmable or otherwise configurable (e.g., with software or firmware) to perform operations on data (e.g., audio, or video or other image data). Examples of processors include a field-programmable gate array (or other configurable integrated circuit or chip set), a digital signal processor programmed and/or otherwise configured to perform pipelined processing on audio or other sound data, a programmable general purpose processor or computer, and a programmable microprocessor chip or chip set. The expressions "audio processor" and "audio processing unit" are used interchangeably, and in a broad sense, to denote a system configured to process audio data. Examples of audio processing units include, but are not limited to encoders (e.g., transcoders), decoders, vocoders, codecs, pre-processing systems, post-processing systems, and bitstream processing systems (sometimes referred to as bitstream processing tools).

Embodiments are directed to systems and methods of decreasing virtual bass delay without requiring substantial changes to existing virtual bass processing components, such as the harmonic transposer used in a virtual bass processing system. Aspects of the virtual bass latency reduction system and method may be used in conjunction with a harmonic generator (transposer) in audio codecs (e.g., in a decoder). Aspects of the virtual bass latency reduction system and method may also be used in conjunction with other transposer or phase vocoder systems, e.g., traditional phase vocoders used for general time-stretching or pitch-shifting of audio signals.

As shown generally in FIG. 1A, virtual bass generation methods using harmonic transposition involve the transposition of frequency components from an inaudible frequency range to an audible frequency range in order to improve playback of bass content in limited playback equipment, such as through small speakers that cannot physically reproduce the missing lower frequencies. Embodiments of the virtual bass latency reduction system and method improve upon virtual bass generation methods that performs harmonic transposition on low frequency components of an audio signal to generate transposed data indicative of harmonics that are expected to be audible during playback, generating a virtual bass signal in response to the transposed data, and generating an enhanced audio signal by combining the virtual bass signal with the (delayed) input audio signal. Typically, the enhanced audio signal provides an increased perceived level of bass content during playback of the enhanced audio signal by one or more loudspeakers that cannot physically reproduce the low frequency components.

The harmonic transposition performed by the virtual bass generation method employs combined transposition to generate harmonics using a second-order transposer and at least one higher order transposer (typically, a third-order and a fourth-order, and optionally at least one additional higher order transposer) of each of the low frequency components, such that all of the harmonics are generated in response to frequency-domain values determined by a common time-to-frequency domain transform stage (e.g., by performing phase multiplication or other manipulation of the phase on frequency coefficients resulting from a single time-to-frequency domain transform), followed by a common frequency-to-time domain transform (in practice, the common frequency-to-time domain transform is split up into two smaller transforms in order to adapt to the bandwidths and sampling frequencies of the sub-bands of the CQMF framework).

Figure 2:
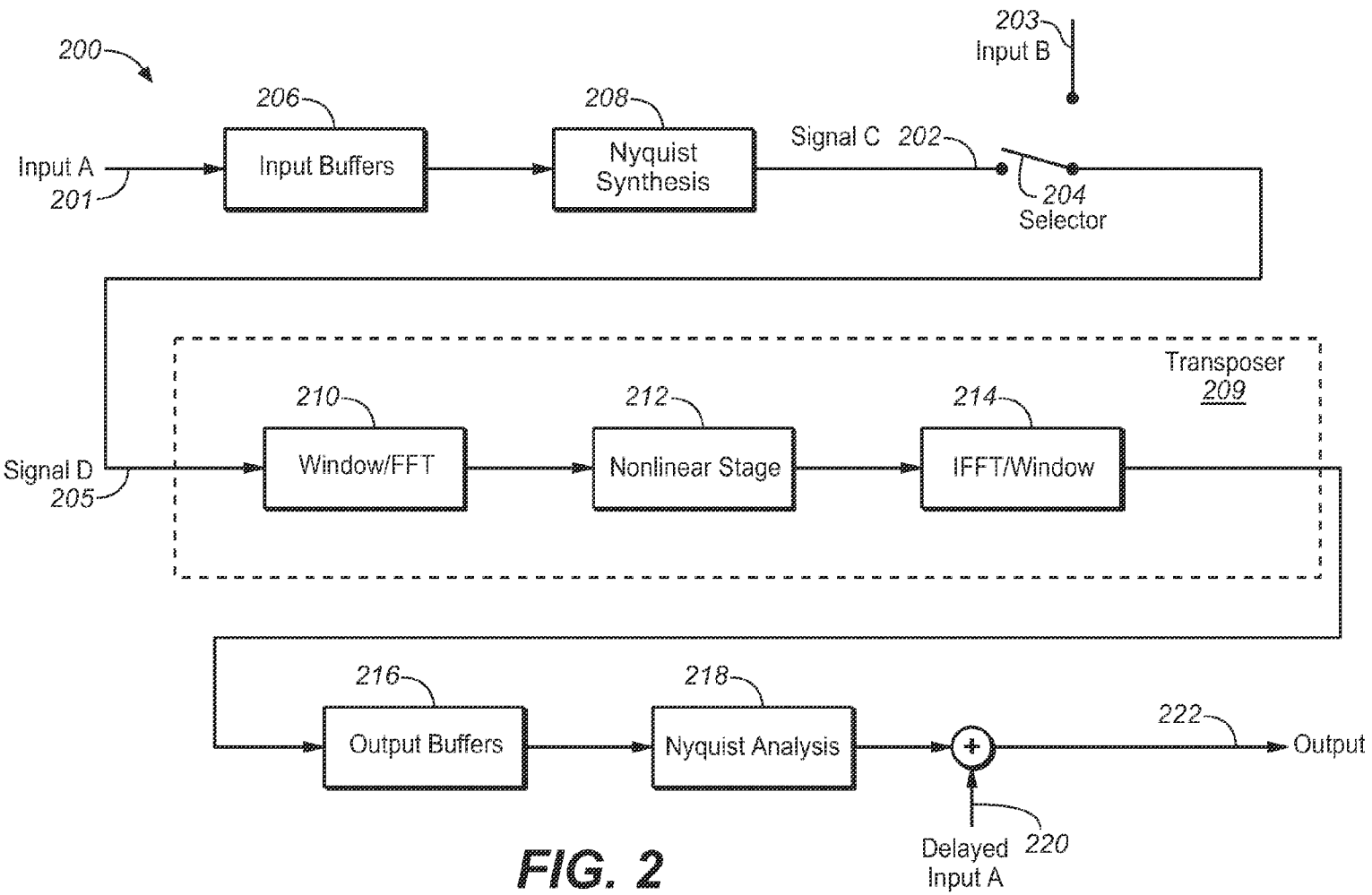
FIG. 2 is a generalized block diagram of a virtual bass processing system that implements latency reduction processes under an embodiment.

FIG. 2 is a block diagram of a virtual bass processing system that implements or is used in conjunction with certain latency reduction processes under an embodiment. In an embodiment, the virtual bass processing system 200 takes as input 201 (input A), a plurality of complex-valued sub-band samples (HQMF samples) from a so-called Hybrid filter bank. In an embodiment, a Hybrid filter bank preceding the virtual bass process has separated an original time domain audio input signal into such multiple Hybrid sub-bands 201 (which are described in further detail below), and they may be buffered by input buffers 206. The buffered input is then processed by a Nyquist synthesis filter bank 208 that performs the synthesis function in order to reconstitute a single complex-valued QMF (CQMF) domain signal 202 (signal C)

indicative of low frequency audio content (e.g., between 0 and 375 Hz). In another embodiment, the virtual bass system includes a latency saving mechanism by bypassing the Nyquist analysis filter bank stage in the preceding Hybrid filter bank. This allows the system to save the delay associated with the Nyquist analysis bank (e.g., 384 samples) by feeding the CQMF channel 0 signal as input 203 (input B) directly to the virtual bass module. As shown in FIG. 2, one of the two inputs 202 or 203 are chosen by a switch, such as selector 204, and the selected signal comprises a virtual bass input signal 205 (signal D) that is further processed by the transposer 209.

A transposer (or phase vocoder) is generally the combination of a time-to-frequency transform or a filter bank followed by a non-linear stage (performing phase multiplication or phase shifting) followed by the frequency-to-time transform or filter bank. Thus, as shown in FIG. 2, transposer 209 comprises a time-to frequency transform component 210, a non-linear stage 212, and a frequency-to-time transform 214. The non-linear stage 212 within transposer 209 is a processing block that modifies the phase and applies certain gain (amplitude) control signals to the sub-band or transform components of the signal. The transposed signals are then buffered by output buffers 216 and subsequently processed by Nyquist analysis filter banks 218 that perform the analysis function that decomposes the virtual bass output CQMF signals into sub-bands corresponding to the Hybrid sub-band samples (HQMF) of the input signal 201. A delayed and unprocessed version of the input A signal 220 is mixed with the Nyquist filter bank 218 output to produce an enhanced audio output signal 222 comprising the virtual bass output signal plus the delayed input signal.

Although embodiments may be directed to the use of Nyquist filter banks for certain functions, such as synthesis 208 and analysis 218 stage processing, it should be noted that other types of filter banks or frequency splitting or partitioning circuits and techniques may also be used. In other embodiments, the above mentioned filter banks or frequency splitting or partitioning circuits and techniques, may not be present at all.

Figure 3A:
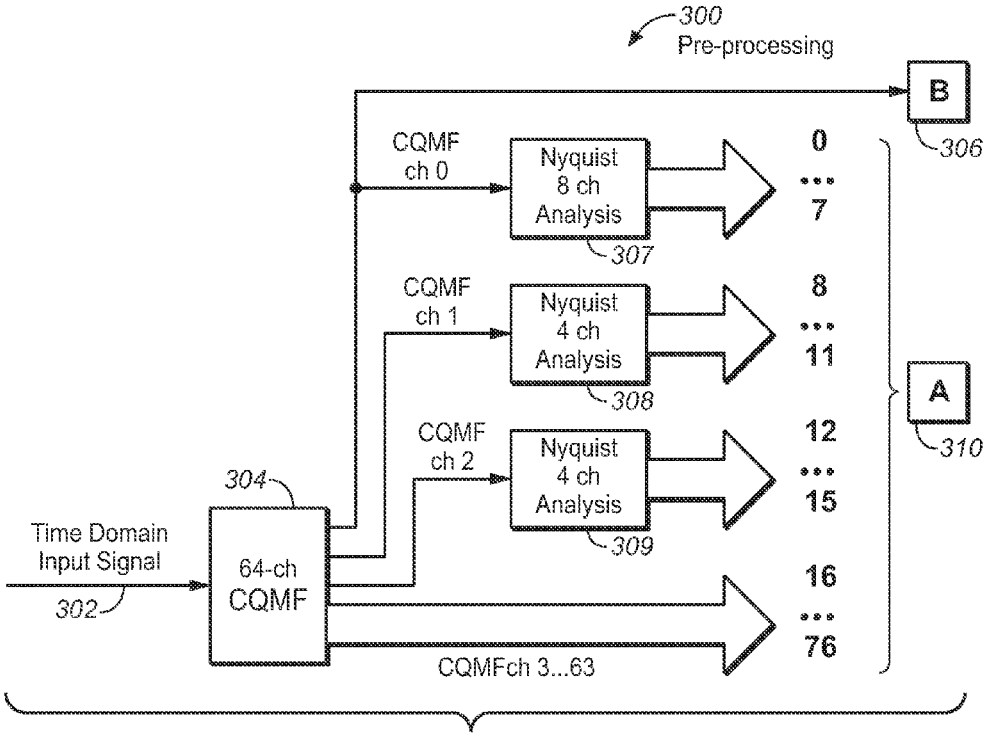
FIG. 3A illustrates a pre-processing Hybrid filter bank stage in a HQMF based system under an embodiment.
Figure 3B:
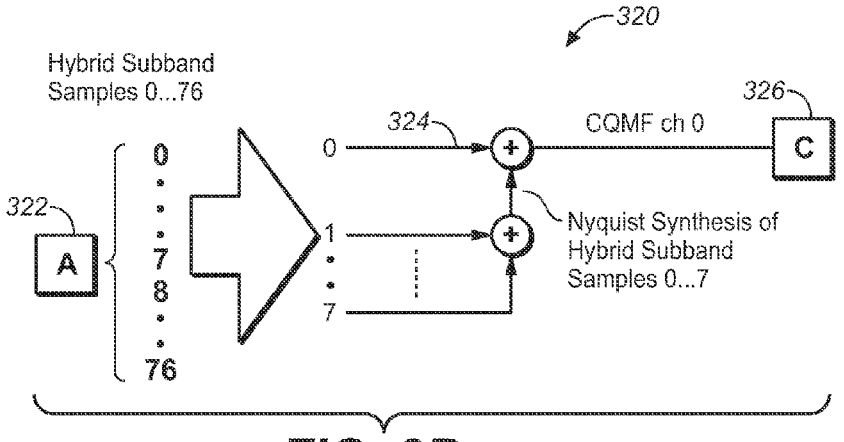
FIG. 3B illustrates a preceding Nyquist synthesis filter bank stage of a virtual bass processing system under an embodiment.
Figure 3C:
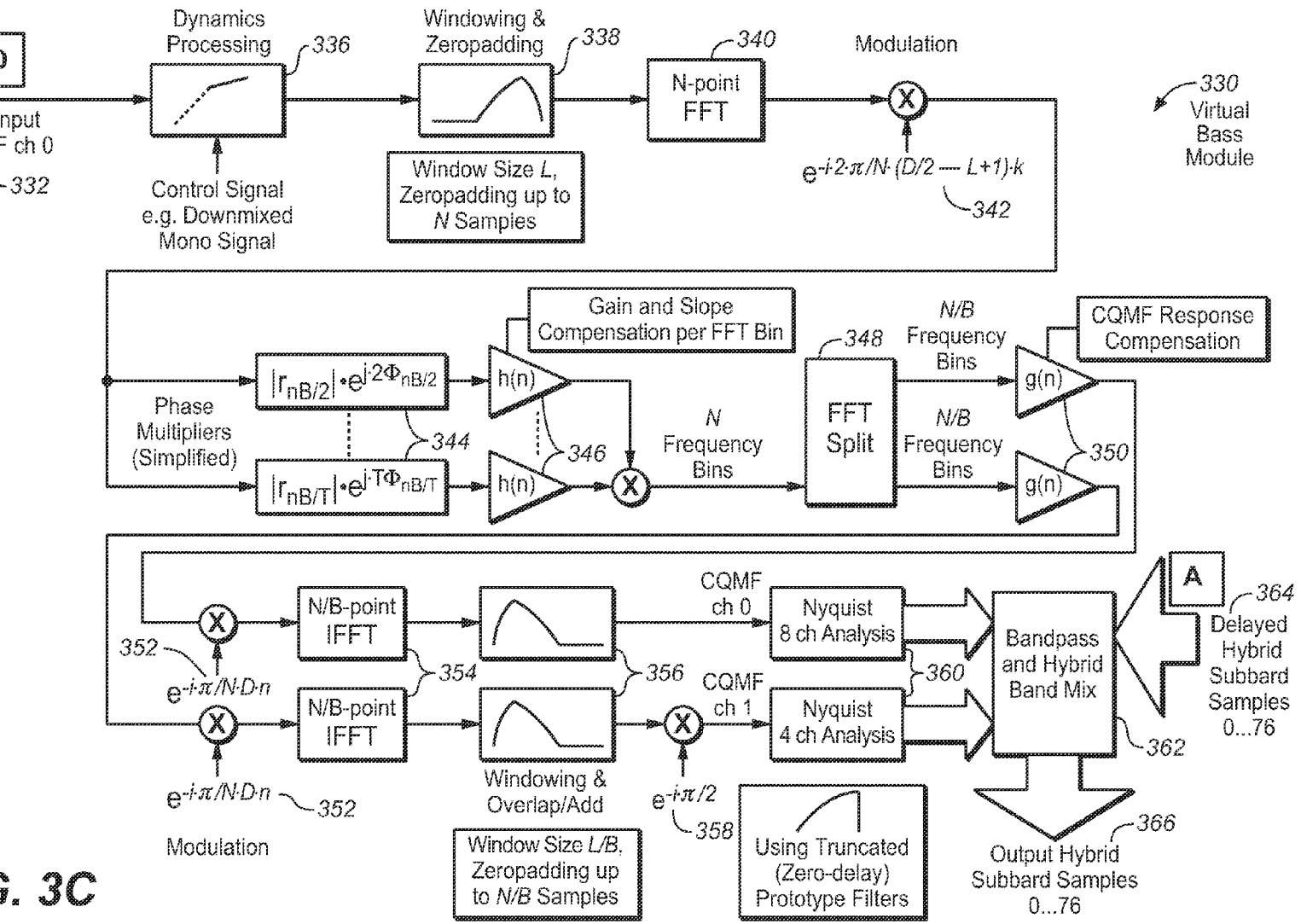
FIG. 3C is a more detailed diagram of the virtual bass processing system illustrated in FIG. 2, under an embodiment.

FIGS. 3A-C are more detailed diagrams of the virtual bass processing system illustrated in FIG. 2. FIG. 3A illustrates a pre-processing Hybrid filter bank stage 300, that is, a stage that typically is not part of, but instead precedes the virtual bass system. A Hybrid filter bank may be the combination of a CQMF bank, where a certain number of the lowest CQMF bands are processed by Nyquist filter banks of pre-determined sizes in order to increase the frequency resolution of the low frequency range. The combination of low frequency sub-band samples from the Nyquist analysis stages and the remaining CQMF channels are referred to as Hybrid sub-band samples, or an HQMF (Hybrid QMF) signal. As shown in FIG. 3A, a time domain input signal 302 is input to a 64-channel CQMF analysis filter bank 304. In an embodiment, one output of this filter bank, the CQMF channel 0 (denoted signal B) 306, is fed directly to the virtual bass module 330 of FIG. 3C (this signal corresponds to input B 203 of FIG. 2). It should be noted that the signal B 306 bypasses the Nyquist analysis filter bank 307, and hence avoids the associated delay. CQMF channels 0, 1, and 2 are also input to a number of Nyquist analysis filter banks 307-309. The output from the Nyquist analysis filter banks and the remaining CQMF sub-bands (3 to 63) produce the Hybrid sub-band samples 0-76 (denoted as signal A) 310.

As shown in system 320 of FIG. 3B, a plurality of complex-valued Hybrid sub-band samples (signal A) 322 are input to a Nyquist synthesis filter bank stage 324. The virtual bass module 330 of FIG. 3C is assumed to be one module amongst other modules in a system that operates on Hybrid sub-band samples (HQMF samples). Hence, signal A 310 of FIG. 3A may undergo processing by other modules after the pre-processing filter bank stage 300 before becoming input A 322 of FIG. 3B. In an example embodiment, the first 8 Hybrid sub-bands, i.e., the sub-bands from the low frequency, eight-channel (8-ch) Nyquist filter bank 307 (which produce a signal bandwidth of roughly 344-375 Hz depending on the sampling rate) are processed. Since a Nyquist filter bank is not down-sampled in contrast to the CQMF bank, the Nyquist filter bank synthesis step is particularly straightforward since it is just a summation of the sub-band samples for each CQMF (or HQMF) time slot. After summation of the eight lowest Hybrid sub-band samples in stage 324, the system has reconstituted the CQMF channel 0 signal C 326, which becomes input 332 to the virtual bass module 330 of FIG. 3C.

FIG. 3C illustrates a virtual bass system that implements or is used in conjunction with certain latency reduction processes, under an embodiment. The virtual bass module 330 of FIG. 3C has signal D 332 as input. In an embodiment where the preceding Nyquist analysis filter bank 307 is bypassed, signal D 332 may be routed from signal B 306 of FIG. 3A. In another embodiment, signal D 332 may be fed from signal C 326 of the Nyquist synthesis stage 320 of FIG. 3B. In both embodiments, signal D 332, i.e., the input signal to the virtual bass module, is a single complex-valued CQMF signal (e.g., the first channel (channel 0) from a set of CQMF sub-band signals).

In a virtual bass application, an optional dynamics processing function may be performed by dynamics processor 336 in order to change the dynamics of the virtual bass input signal. The processor 336 may be used to decrease the level of weak bass and maintain or enhance strong bass, i.e., be used as an expander. This scheme is in agreement to the shapes of the Equal Loudness Contours (ELC) in the bass range, where the loudness curves are flatter in frequency for louder signals and steeper for signals of weaker loudness. Weaker bass can hence be attenuated more than stronger bass when generating harmonics in order to maintain the relative loudness between the fundamental component and the generated harmonics. The gain of the dynamics processor 336 may be controlled by a running average energy signal, e.g., the running average energy of a down-mixed (mono) version of the first CQMF band signal 332.

For the embodiment of system 330, a first windowing function using a window size L (including zero-padding up to length N) 338, forward FFT 340 and modulation function 342 is performed on the (possibly dynamics processed) CQMF signal prior to input to the non-linear processing block 344. In an embodiment of the invention, the window shape is asymmetric. In another embodiment, the transposer (comprising components 338 to 356) represents an improved phase vocoder that uses an interpolation technique referred to as "combined transposition" to generate second, third, fourth, and possibly higher order harmonics (transposition factors), using the same FFT analysis/synthesis chain as for the base transposer. In general, such combined transposition saves computational complexity, though the quality of the other harmonics than the base order harmonics may be somewhat compromised. Without combined transposition, at least either the forward or the inverse transforms need to be separate for the different transposition factors. The non-linear processing block 344 uses integer transposition factors, which makes redundant certain phase estimation, phase unwrapping, or phase locking techniques that are generally unstable and inexact as used in many standard phase vocoders. In one embodiment, the phase multipliers 344 use a base transposition factor B higher than 2, such as 8, or any other appropriate value.

The transposer 338-356 uses oversampling in the frequency domain (i.e., zero-padded analysis and synthesis windows in blocks 338 and 356) to improve impulsive (percussive) sounds, which is paramount when used in the bass frequency range. Without such oversampling, percussive drum sounds would likely generate at least some pre- and post-echo artifacts, making the bass blurry and indistinct. In an embodiment, the oversampling factor F is selected to be at least a factor F=(B+1)/2, where B is the base transposition factor (e.g., B=8). This helps to ensure that pre- and post-echoes are suppressed for isolated transient sounds.

As shown in FIG. 3C, the transposer includes gain and slope compensation per FFT bin applied by amplifiers 346 following the phase multiplier circuits (non-linear processing block 344). This allows overall gains for different transposition factors to be set independently. For example, gains can be set to approximate certain equal loudness contours (ELC). As an approximation, the ELC can be adequately modeled by straight lines on a logarithmic scale for frequencies below 400 Hz. In this case, odd order harmonics can be attenuated to a greater extent since odd order harmonics (e.g., third, fifth, etc.) can sometimes be perceived as being more harsh than even order harmonics, although being important for the resulting virtual bass effect. Each transposed signal may additionally have a slope gain, i.e., a roll-off attenuation factor, measured in e.g., dB per octave. This attenuation is also applied per bin in the transform domain by amplifiers 346.

In a non-Hybrid filter bank based system, e.g., a time domain system, taking signal 302 of FIG. 3A as input, the transposer 338-356 would directly operate on a time domain signal of full sampling rate (e.g., 44.1 or 48 kHz), and then employ an FFT size of roughly 4096 lines, in order to provide an adequate resolution in the low frequency (bass) range. In an embodiment, all processing, however, is performed on CQMF channel 0 sub-band samples (signal D 332 of system 330). This provides certain advantages over normal processing practices, such as saving computational complexity by processing only the signal of interest in the transposer, i.e., by processing a critically sampled (or maximally decimated) low-pass signal. For example, by using a fourth-order base transposer, the virtual bass system expands the bandwidth of the input signal by a factor of four. In general, a virtual bass system is not required to output a signal with a bandwidth above roughly 500 Hz. This means that the first CQMF channel (channel 0) having a bandwidth of 375 Hz (for $f_s$=48 kHz) is more than adequate for the virtual bass input, and the first two CQMF channels (channels 0 and 1) have enough bandwidth (750 Hz at $f_s$=48 kHz) for the virtual bass output. Having CQMF channel 0 as input, the system can process the complex-valued samples using an FFT transform of size 64 (4096/64) instead of 4096, where the decrease by 64 comes from the down-sampling factor of the CQMF bank, which also equals the reduced bandwidth of the first CQMF sub-band signal compared to the time domain input signal. Because of the inherent bandwidth expansion, the output from the transposer needs to be transformed to CQMF bands 0 and 1. This may be done approximately by a split of the 64-line FFT into four 16-line FFTs and subsequently employing CQMF prototype filter response compensation in the transform domain before the inverse FFT of the two 16-line FFTs that constitute CQMF band 0 and 1 are calculated. Note that in the example above, frequency domain oversampling is not considered, as it would increase the forward and inverse transform sizes by the oversampling factor mentioned earlier. In an application, the FFT spectrum may be split in module 348 of the virtual bass module 330 and the CQMF filter response compensation may be done by multipliers 350. In other embodiments, the CQMF filter response compensation may be done on the full (e.g., 64-lines in the example above) FFT spectrum before the FFT split module 348.

As further shown in FIG. 3C, the output from the CQMF filter response compensation blocks 350 is input to modulation steps 352 followed by inverse FFT circuits 354, using transform sizes of N/B points, and subsequent windowing and overlap/add steps 356, using window lengths L/B. In an embodiment of the invention, the window shapes are asymmetric. The modulation steps 352 may also be applied before the FFT split 348 and CQMF filter response compensation 350 blocks. The output signals from the windowing and overlap/add circuits 356 are two CQMF signals, containing the virtual bass signal to be mixed with the delayed HQMF signal A 364. However, both signals need first be filtered through 8- and 4-channel Nyquist analysis filter banks 360 respectively to fit in the Hybrid domain. In an embodiment of the invention, the Nyquist analysis filter banks 360 use truncated prototype filters. The HQMF output from the filter banks 360 may be band pass filtered and mixed with a delayed input component A 364 in module 362 to produce the enhanced audio output HQMF signal 366. In an embodiment, the delay of input A 364 to the Hybrid band mix block 362 is less than the virtual bass system delay (minus the Nyquist analysis delay if signal B 306 is used as input) to comprise a time lagged virtual bass signal.

The phase relations between the sub-band signals coming from a CQMF analysis bank will not be maintained when performing the FFT split as outlined above. To alleviate this in an embodiment, system 330 employs phase compensation by an $\exp(-j\cdot\pi/2)$ multiplication 358 on the CQMF channel 1 before the Nyquist analysis blocks 360. The specific argument to the phase compensation function 358 is dependent on the modulation scheme used by the preceding CQMF bank 304 of FIG. 3A and may differ between embodiments. Also, the compensation factor 358 may be moved and absorbed in other processing blocks.

Virtual Bass Latency Reductions

Figure 1B:
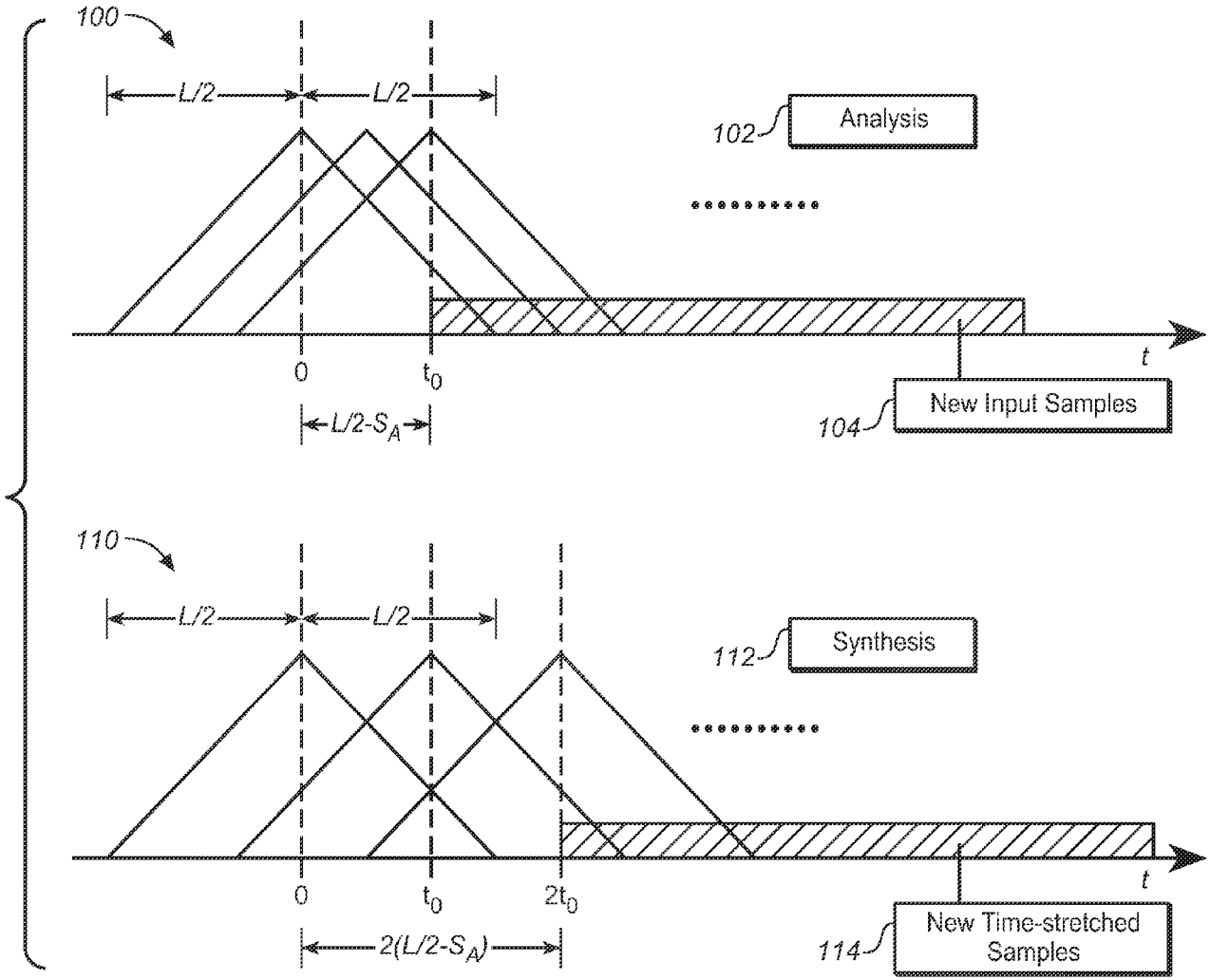
FIG. 1B (PRIOR ART)
FIG. 1B illustrates the delay associated with symmetric windows used in legacy virtual bass systems, as known in the prior art.

As described in the background section, the virtual bass processing system introduces certain delays when processing the input signal. With reference to FIG. 1B, the delay (measured on the transposer output sampling frequency) of the legacy transposer can be expressed as $D=3\cdot L/2-2\cdot S_A$, where L is the transposer window size and $S_A$ is the analysis stride or hop-size. In a system in which L=64 and $S_A$=4, the total delay of the transposer and the Nyquist filter bank analysis stage can be in the order of 3200 samples, as described previously.

Figures 4, 5A, 5B:
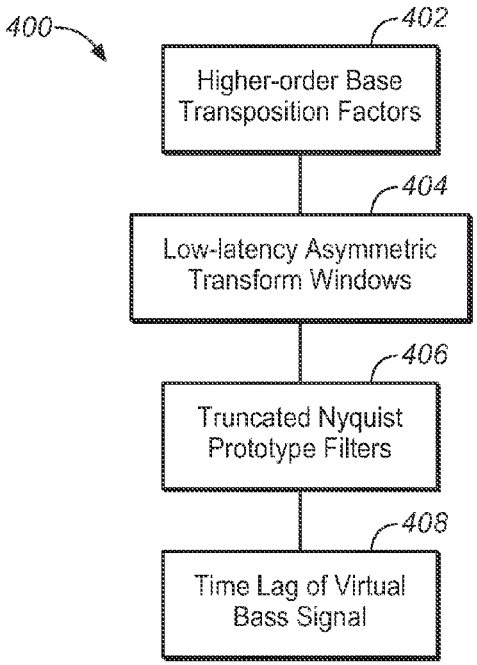
FIG. 4 is a block diagram of the principal functional components utilized by a virtual bass latency reduction process and system, under an embodiment.
FIG. 5A is a table illustrating the delay associated with a first hop size for a virtual bass latency reduction system using different orders of the base transposition factor, under an embodiment.
FIG. 5B is a table illustrating the delay associated with a second hop size for a virtual bass latency reduction system using different orders of the base transposition factor, under an embodiment.

In an embodiment, the virtual bass processing system includes components that perform certain steps to reduce the latency associated with virtual bass processed content. FIG. 4 is a block diagram of the principal functional components utilized by a virtual bass latency reduction process and system, under an embodiment. As shown in diagram 400 of FIG. 4, the latency reduction process comprises the use of higher order base transposition factors 402, low-latency asymmetric transform windows 404, truncated Nyquist prototype filters 406, and a time lagged virtual bass signal 408. Each of the functional components of diagram 400 may be used alone or in conjunction with one or more of the other components to help reduce the latency of the virtual bass processed content. Diagram 400 may represent a system, such as when each of the components 402-408 is embodied as hardware component, such as circuits, processors, and so on. The diagram may also represent a process, such as when each of the components 402-408 is implemented as an act performed by a functional component, such as a computer-implemented process executed by one or more processors. Alternatively, diagram 400 may represent a hybrid system and method wherein certain components may be implemented in hardware circuitry and others may be implemented as performed method steps. The components 402-408 may be implemented as separate stand-alone components, or they may be combined in one or more consolidated latency reduction functions. A detailed description of the composition and operation of each component of system 400 follows below.

Higher-order Base Transposition Factors

With regard to the higher-order base transposition factors 402 of FIG. 4, the legacy transposer delay equation of $D_{ts}=\{3\cdot L/2-2\cdot S_A\}\cdot 64/2$ (Eq. 2), can be deduced as shown in Eq. 3:

$$D_{ts}=\{(B+1)\cdot L/2-B\cdot S_A\}\cdot 64/B \quad \text{(Eq. 3)}$$

In Eq. 3, the base transposition factor 2 of the legacy system is replaced by the arbitrary integer base transposition factor B. Note that Eq. 3 refers to the delay in output samples of a CQMF based framework having 64 channels. It can be verified that for constant L and $S_A$, the delay is decreased for increasing B. FIG. 5A is a table illustrating the delay associated with a first hop size, and FIG. 5B is a table illustrating the delay associated with a second hop size for a virtual bass latency reduction system under an embodiment. Table 1 of FIG. 5A illustrates the latency for a hop size of $S_A=4$, for various window sizes (L=16 to 128) and base transposition factors (B=2 to 16). In comparison, Table 2 of FIG. 5B illustrates the latency for a hop size of $S_A=2$, for the same various window sizes (L=16 to 128) and base transposition factors (B=2 to 16). As can be seen in FIGS. 5A and 5B, by increasing the base transposition factor from 2 to 8, for example, a significant latency reduction can be achieved (e.g., from 2816 to 2048 samples for the nominal case where L=64 and $S_A=4$).

With reference to FIG. 3C, in the combined transposer 338-356, when generating higher order transposition factors T, where T is greater than B (T>B), the transposer source ranges are smaller than the transposer target ranges in the analysis transform spectrum. The target bins result from interpolation of the source bins. When generating lower order transposition factors using a higher order base transposer, i.e., when T is less than B (T<B), the source ranges will be larger than the target ranges and the target bins result from decimation of source bins. However, also for the case T<B, when T is odd, the source bin index derived as k=n·B/T, where n is the target bin index, will generally not be an integer and hence the target bin will be derived from interpolation of two consecutive source bins.

The increased order of the base transposition factor has certain implications on the virtual bass process. First, control needs to be established to enforce the transposer source range to stay within the analysis transform range (i.e., within the range 0 to N−1). Second, comparing with a system using a base transposition factor of 2, the two synthesis transforms 354 will now be of size N/B instead of N/2, where N is the analysis transform size. This means that the synthesis window will be decimated by a factor of B instead of 2, and the spectrum splitting 348 along with the gain-vectors for filter response compensation 350 will also be downscaled accordingly. This is a consequence of the increased bandwidth expansion for higher values of B; the transposer output inherently covers a frequency range of B CQMF bands (assuming an input of one CQMF band), where only the first two will actually be synthesized, thus saving complexity. For a base transposition factor B=8 and a frequency domain oversampling factor F=4, the two synthesis transform sizes are $N_S=F\cdot L/B=4\cdot 64/8=32$, and the synthesis transform windows 356 have only L/B=64/8=8 taps.

The quality of the transposed signals is governed by the base transposition factor and gets reduced for higher order transposition orders, but can be improved by using a decreased analysis hop-size (increased oversampling in the time domain). Moreover, to maintain the quality for percussive sounds (transients), the order of frequency domain oversampling needs to increase for higher base transposition factors. However, the increased oversampling in both time and frequency may add to the computational complexity of the transposer. In an embodiment, the analysis hop-size is decreased a factor of two compared to the legacy system. A base transposer of factor B=8 will require a frequency domain oversampling factor of at least F=(B+1)/2=4.5. In an embodiment, the system uses a factor four oversampling (F=4) and the missing value of 0.5 is generally insignificant in practice as the transform windows are tapered in the ends. Hence, in this embodiment, the computational complexity is increased by a factor of two in total coming from the increased oversampling in time. It should be noted that the increased time oversampling also comes at a price of slightly increased delay, ending up with a total latency of 2176 samples for L=64, B=8 and $S_A=2$, as shown in Table 2 of FIG. 5B.

Asymmetric Transform Windows

Given what is shown in Tables 1 and 2 of FIGS. 5A and 5B, it may be presumed that an obvious way of decreasing the transposer delay is to use shorter transform windows, and hence smaller analysis and synthesis transform sizes. However, this generally comes at a cost of reduced quality for dense tonal signals, because of the decreased frequency resolution resulting from the shorter transform windows. It has been found that a more robust decrease of the algorithmic delay of the transposer can be achieved by using asymmetric analysis and synthesis windows in the forward and inverse transforms stages. Thus, with regard to the low latency asymmetric transform 404 of FIG. 4, in an embodiment, the latency reduction system uses asymmetric analysis and synthesis windows in the forward and inverse transform stages (e.g., windowing stages 338 and 356 of FIG. 3C, respectively). This essentially improves the frequency response of a symmetric window of limited length by extending the "tail" of the window towards samples in the history not contributing to the transform delay. In an even more general embodiment, both the length of the analysis window and the size of the forward transform may be different from that of the synthesis window and the inverse transform.

Figure 5C:
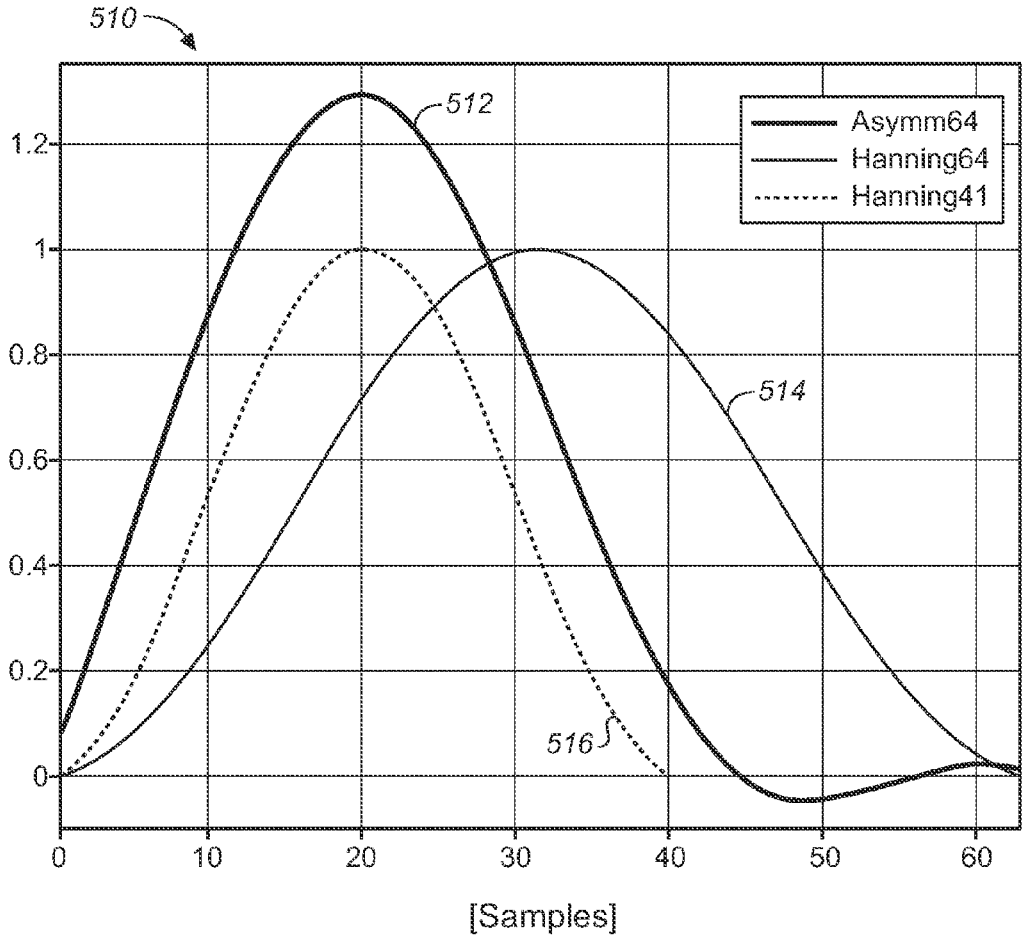
FIG. 5C is an example plot of time responses of an asymmetric window compared to certain legacy symmetric windows.
Figure 5D:
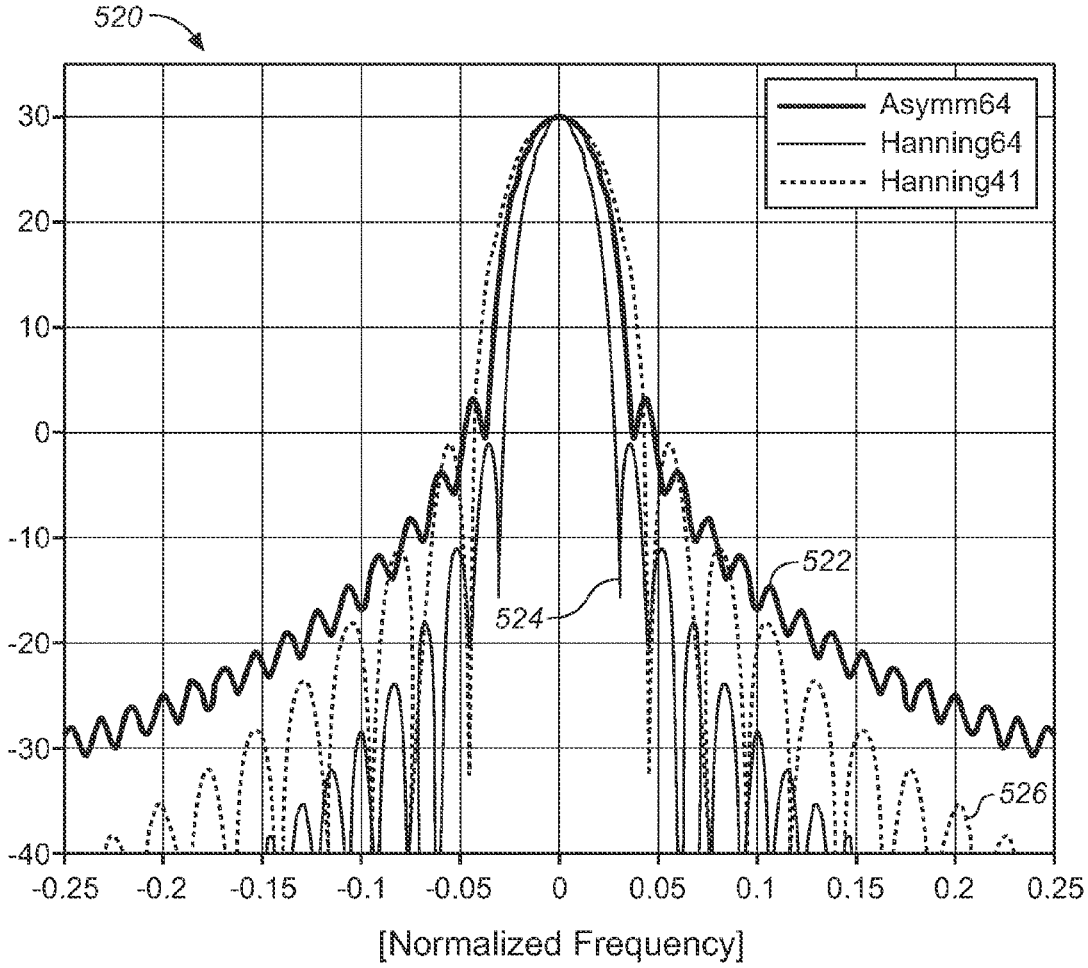
FIG. 5D is an example plot of frequency responses of an asymmetric window compared to certain legacy symmetric windows.

FIG. 5C is an example plot of a time response of an asymmetric window compared to legacy symmetric Hanning windows. FIG. 5C illustrates the time response as a function of samples (x-axis) versus signal amplitude (e.g., in volts) for a Hanning window of length 64 shown as plot 514 and a Hanning window of length 41 shown as plot 516 versus the time response plot 512 for an asymmetric window of length 64 and delay 40 (a delay equal to the Hanning window of length 41). FIG. 5D is an example plot of frequency responses of an asymmetric window compared to legacy symmetric Hanning windows. FIG. 5D illustrates the frequency response as a function of normalized frequency (x-axis) versus signal amplitude on a logarithmic scale (e.g., in dB) for the Hanning window of length 64 shown as plot 524 and the Hanning window of length 41 shown as plot 526 versus the frequency response plot 522 for the asymmetric window of length 64 and delay 40 (equal to the Hanning window of length 41). As can be seen in FIG. 5D, the main lobe of the asymmetric window has a width in between those of the symmetric Hanning windows, indicating a frequency resolution or selectivity in between the two Hanning windows.

To accommodate for asymmetric window transform processing, the transposer algorithm need to be partially changed compared to the legacy implementation, taking into account the reduced transform delay D of the analysis/synthesis chain. Instead of the frequency modulation by $e^{-i\pi k}$ following the forward transform and preceding the inverse transform of the legacy system, the asymmetric system requires a frequency modulation 342 after the analysis transform of:

$$M_A(k)=e^{-i\cdot(2\cdot\pi/N)(D/2-L+1)\cdot k},\ 0\le k<N \quad \text{(Eq. 4)}$$

The system also requires a modulation before the split of the synthesis FFT spectrum of:

$$M_S(n)=e^{-i\cdot(\pi/N\cdot D\cdot n)},\ 0\le n<N \quad \text{(Eq. 5)}$$

In Eqs. 4 and 5 above, k and n respectively are the transform frequency coefficient indices, N is the analysis transform size, i.e., N=FL, where F is the frequency domain oversampling factor, L is the analysis window size and D is the transform delay. As indicated in FIG. 3C, the modulation of Eq. 5 may also be applied in modulation stages 352 after the FFT split module 348 and response compensation step 350.

Figure 6:
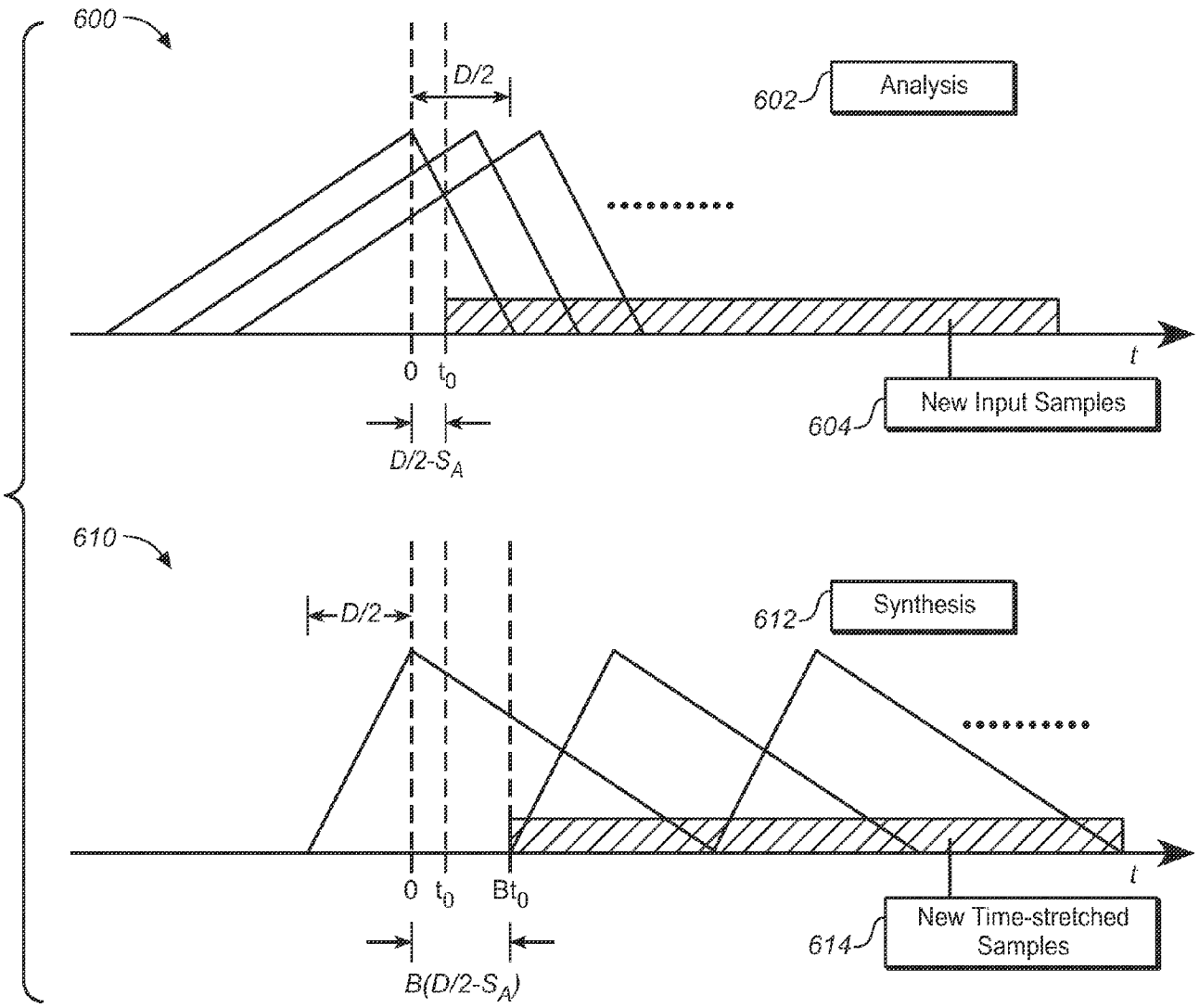
FIG. 6 illustrates the use of asymmetric windows and the associated delay imposed by a B-order base transposer, under an embodiment.

FIG. 6 illustrates stylistically the use of asymmetric windows and the associated delay imposed by a B-order base transposer, under an embodiment. In a legacy virtual bass system, B is usually set to two, but if the asymmetric window process 404 is used in conjunction with the higher-order base transposition factor process 402, then B will be an integer value of greater than two (e.g., B=4, 8 or 16). Time plot 600 shows the time zero reference as the group delay of the analysis window (approximately D/2). New samples 604 are added from time $t_0$ in the analysis phase 602. Time plot 610 shows that the time stretch duality of the transposer moves $t_0$ to time $B\cdot t_0$ in the synthesis phase 612 for the new time-stretched samples 614. The total analysis/synthesis chain delay amounts approximately to: $D/2+B\cdot(D/2-S_A)$ in the case where asymmetric windows, such as shown in FIG. 5 (512) or FIG. 6 are used.

As for the symmetric window case, where the frequency domain modulations may be implemented by circular time shifts by N/2 samples, the calculations of Eqs. 4 and 5 above may likewise be implemented by circular time shifts of N−(D/2−(L−1)) (mod N) samples before the analysis transform and N−D/2 samples after a (single) synthesis transform respectively. However, when combining asymmetric windows with a higher order base transposition factor, e.g., B=8, and the FFT split stage 348, the time shifts after the synthesis transforms will be (N−D/2)/B samples, which may not be an integer value. In this case, a rounded value may be used as an approximation. Additionally, in order to save complexity, the analysis modulation may be combined with the synthesis modulation as a merged synthesis modulation as given by Eq. 6:

$$M_{ASC}(k)=e^{-i\cdot(2\cdot\pi/N)(D/2\cdot(B+1)-L+1)\cdot B)\cdot k},\ 0\le k<N \quad \text{(Eq. 6)}$$

The combined modulation of Eq. 6 will only be exact when the transposition factor T equals B. For other transposition factors, Eq. 6 will also be an approximation.

Alternatively, the modulation of Eq. 6 may be implemented as combined circular time shifts after the synthesis transforms as shown in Eq. 7:

$$f_x(m)=g_x(S+m),\ 0\le m<N/B-S$$

$$f_x(N/B-S+m)=g_x(m),\ 0\le m<S \quad \text{(Eq. 7)}$$

In the above Eq. 7, $g_x(m)$ is the time-domain output from one of the synthesis inverse transforms, $f_x(m)$ is the shifted time sequence and S equals:

$$S=\lceil N/B-D/2\cdot(1/B+1)+L-1\rceil(\text{mod } N/B),$$

Again, Eq. 7 provides only an approximation of the frequency modulation implemented by Eq. 6 (which in itself may be an approximation) when the argument to the ceil-function $\lceil\cdot\rceil$ (rounding up to closest integer) is not an exact integer. It should also be noted that Eqs. 5 or 6 above are preferably applied only to the limited part of the coefficients that will be included in the two inverse Fourier transforms.

With reference to FIG. 6, the exact expression for the total system delay of the asymmetric window transposer framework becomes as shown in Eq. 8:

$$D_{ta}=\{(B+1)\cdot D/2-B\cdot(S_A-1)\}\cdot 64/B \quad \text{(Eq. 8)}$$

Again, Eq. 8 refers to the delay in output samples using a 64-channel CQMF based framework.

Figures 7A, 7B, 8:
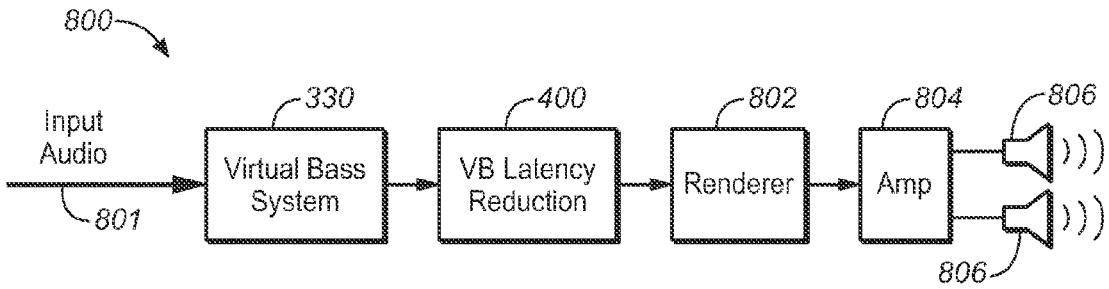
FIG. 7A is a table illustrating the total latency values for a first hop size for a virtual bass latency reduction system that uses asymmetric transform windows and different orders of the base transposition factor, under an embodiment.
FIG. 7B is a table illustrating the total latency values for a second hop size for a virtual bass latency reduction system that uses asymmetric transform windows and different orders of the base transposition factor, under an embodiment.
FIG. 8 is a block diagram illustrating an audio processing system that includes a virtual bass generation system and latency reduction system, under an embodiment.

FIG. 7A is a table illustrating the total latency values for a first hop size, and FIG. 7B is a table illustrating the total latency values for a second hop size for a virtual bass latency reduction system that uses asymmetric transform windows, under an embodiment. Table 3 of FIG. 7A illustrates the latency for a hop size of $S_A$=4, for various transform delay values (D=15 to 127) and base transposition factors (B=2 to 16). In comparison, Table 4 of FIG. 7B illustrates the latency for a hop size of $S_A$=2, for the same various transform delay values (D=15 to 127) and base transposition factors (B=2 to 16). As can be seen in Table 4, the latency reduction going from a symmetric 64-tap window (D=63) to the asymmetric window is 828 samples (2204−1376=828, for a nominal case where $S_A$=2 and B=8).

Comparing Eq. 3 and Eq. 8, it can be verified that setting $D_{ts}=D_{ta}$ gives:

$$D=L-(2\cdot B/(B+1)) \quad \text{(Eq. 9)}$$

The above Eq. 9 expresses the expected transform delay of D=L−1 for a symmetric window when B=1.

The amount of asymmetry of the transposition windows may vary depending upon the constraints and requirements of the system. In an embodiment and particular implementation, the group delay of the asymmetric window is selected to be close to half of the transform delay in order to maintain adequate transposition quality. Thus, in this case, $G_d\approx D/2=20$. This may be accomplished by including a constraint for the group delay during an optimization phase for design of the asymmetric filter.

Truncated Nyquist Prototype Filters

With reference to FIG. 4, a third latency reduction element comprises using truncated Nyquist prototype filters, 406. As shown in FIG. 3C, to be able to mix the virtual bass signal in the Hybrid domain, 8-channel and 4-channel Nyquist analysis filter banks 360 are applied to the virtual bass output CQMF channels (these filter banks correspond to the Nyquist filter banks 307 and 308 of FIG. 3A). In an embodiment, the Nyquist analysis filter banks 360 use symmetric 13-tap prototype filters, which can result in a delay of six CQMF samples (e.g., in this case, 6.64=384 output samples). By removing the six coefficients of the prototype filter that act on future samples this entire delay (e.g., 384 samples) may be eliminated. In general, the Nyquist analysis/synthesis chain still provides perfect reconstruction. However, the frequency responses of the Nyquist filter banks using truncated filters may change. Optimization of the remaining filter coefficients may improve the potentially poorer frequency responses of the Nyquist filter banks using truncated filters.

Time Lagged Virtual Bass Signal

With reference to FIG. 4, a fourth latency reduction element comprises letting the virtual bass signal lag the original signal, 408. In this case, the latency of the overall system can be reduced as the wide band signal (i.e., the Hybrid signal A 364 of FIG. 3C) is delayed a shorter period of time than the virtual bass system delay actually implies. Informal listening tests have shown that a lag below 20 ms does not hamper the virtual bass effect. This lag corresponds to 960 samples for a 48 kHz audio signal.

In a particular implementation of an embodiment, the virtual bass signal is allowed to lag the wide band signal by a total of 352 samples (7.33 ms at 48 kHz). Of these 352 samples, 32 samples are coming from the use of the asymmetric transform window as 1376 is not evenly divisible by the CQMF filter bank size of 64. Hence, the delay from the asymmetric window transform can be divided into a wide band latency of 1344 plus a bass lag of 32 samples. The extra lag added on top of the 32 samples is thus 320 samples (5 CQMF samples, corresponding to 6.67 ms at 48 kHz sampling frequency).

The different latency reduction elements 402-408 of FIG. 4 may be used in any practical number of combinations to achieve a reduction in virtual bass system latency. Furthermore, the appropriate variables of each latency reduction method may be altered to increase the latency in relation to any perceived decrease in virtual bass signal quality. In an embodiment, the four latency reduction elements were implemented using the following values: base transposition factor B=8, hop-size $S_A$=2, transform delay D=40, truncated Nyquist filters and 320 samples of extra virtual bass lag. In this example case, the resulting virtual bass system delay in output samples was as follows:

$$D_{VB}=\{(B+1)\cdot D/2-B\cdot(S_A-1)\}\cdot 64/B-32+0-320=1376=352=1024$$

Circumventing the Nyquist analysis filter bank in the preprocessing stage as described above, (such as by using input B 203 in FIG. 2, and signal B 306 of FIG. 3A as input D 332 in the virtual bass module 330 of FIG. 3C), can save another 384 samples of delay, resulting in a virtual bass system delay 1024−384=640 samples (corresponding to 13 ms at 48 kHz sampling frequency).

The delay of 640 samples in this example case is significantly less than the nominal delay of 3200 samples in the legacy virtual bass system described previously. This delay can be reduced even further by adding more virtual bass lag, by increasing the hop-size $S_A$ to 4 instead of 2, or by designing an asymmetric transform window with a resulting analysis/synthesis delay shorter than 40. However, the change of any such values may result in slightly poorer virtual bass quality, though the latency may be further reduced.

Embodiments of a virtual bass latency reduction system as described herein may be used in conjunction with any appropriate virtual bass generation system, such as that illustrated in FIGS. 2 and 3. FIG. 8 is a block diagram illustrating an audio processing system that includes a virtual bass generation system and a latency reduction system, under an embodiment. As shown in FIG. 8, system 800 comprises a virtual bass system 330 as illustrated in FIG. 3C. Virtual bass system 330 receives input audio signals 801 and performs certain frequency transposition functions to produce enhanced audio content for playback through speakers 806 that may be of limited frequency response capability. Certain latencies may be associated with the transposition functions performed by the virtual bass system 330. In an embodiment, a virtual bass latency reduction system 400 (as illustrated in FIG. 4) is provided as a post-process to the virtual bass system 330 to reduce the latencies associated with virtual bass processing. The reduced latency audio signals from the virtual bass systems 330 and 400 are then sent to a rendering subsystem 802 that is configured to generate speaker feeds that may be fed through amplifier 804 for left and right (or multi-channel) speakers 806.

Although the virtual bass latency reduction system 400 is shown to be a separate post-process element in system 800, it should be noted that such a latency reduction system may be implemented as part of the virtual bass system 330 (as indicated earlier), or as part of any other appropriate element of system 800, such as a functional component within rendering subsystem 802. Likewise, the virtual bass system 330 may be a legacy virtual bass generation system as outlined in the background, or it may be any other virtual bass generation and processing system that uses harmonic transposition to enhance input audio signals 801 to increase the perceived level of bass content for playback through speakers 806.

Embodiments of the virtual bass latency reduction system can be used in any audio processing system that renders and plays back digital audio through a variety of different playback devices and audio speakers (transducers). These speakers may be embodied in any of a variety of different listening devices or items of playback equipment, such as computers, televisions, stereo systems (home or cinema), mobile phones, tablets, and other portable playback devices. The speakers may be of any appropriate size and power rating, and may be provided in the form of free-standing drivers, speaker enclosures, surround-sound systems, soundbars, headphones, earbuds, and so on. The speakers may be configured in any appropriate array, and may include monophonic drivers, binaural speakers, surround-sound speaker arrays, or any other appropriate array of audio drivers.

Aspects of one or more embodiments described herein may be implemented in an audio system that processes audio signals for transmission across a network that includes one or more computers or processing devices executing software instructions. Any of the described embodiments may be used alone or together with one another in any combination. Although various embodiments may have been motivated by various deficiencies with the prior art, which may be discussed or alluded to in one or more places in the specification, the embodiments do not necessarily address any of these deficiencies. In other words, different embodiments may address different deficiencies that may be discussed in the specification. Some embodiments may only partially address some deficiencies or just one deficiency that may be discussed in the specification, and some embodiments may not address any of these deficiencies.

Aspects of the systems described herein may be implemented in an appropriate computer-based sound processing network environment for processing digital or digitized audio files. Portions of the adaptive audio system may include one or more networks that comprise any desired number of individual machines, including one or more routers (not shown) that serve to buffer and route the data transmitted among the computers. Such a network may be built on various different network protocols, and may be the Internet, a Wide Area Network (WAN), a Local Area Network (LAN), or any combination thereof.

One or more of the components, blocks, processes or other functional components may be implemented through a computer program that controls execution of a processor-based computing device of the system. It should also be noted that the various functions disclosed herein may be described using any number of combinations of hardware, firmware, and/or as data and/or instructions embodied in various machine-readable or computer-readable media, in terms of their behavioral, register transfer, logic component, and/or other characteristics. Computer-readable media in which such formatted data and/or instructions may be embodied include, but are not limited to, physical (non-transitory), non-volatile storage media in various forms, such as optical, magnetic or semiconductor storage media.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

While one or more implementations have been described by way of example and in terms of the specific embodiments, it is to be understood that one or more implementations are not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A method of generating low latency virtual bass, comprising:

receiving an input audio signal;

performing harmonic transposition on low frequency components of the input audio signal to generate transposed data indicative of harmonics of the input audio signal;

generating a virtual bass signal in response to the transposed data; and generating an enhanced audio signal by combining the virtual bass signal with a delayed version of the input audio signal, wherein the harmonic transposition employs combined transposition using a base transposition order B higher than 2 such that the harmonics include a second order harmonic and at least one higher order harmonic of each of the low frequency components, and such that all of the harmonics are generated in response to frequency-domain values determined by a common time-to-frequency domain transform stage using an asymmetric analysis window, and a subsequent inverse transform determined by a common frequency-to-time domain transform stage using an asymmetric synthesis window.

2. The method of claim 1 wherein the base transposition factor B is an integer value selected from the group consisting of: 4, 8, 16 or 32.

3. The method of claim 1 wherein the input audio signal is a sub-band complex-valued quadrature mirror filter (CQMF) signal indicative of critically sampled or close to critically sampled low frequency audio from a set of CQMF sub-band signals.

4. The method of claim 3 wherein the critically sampled or close to critically sampled low frequency input audio is a CQMF channel 0 signal indicative of the lowest frequency band from a set of CQMF sub-band signals.

5. The method of claim 4 further comprising:

generating transposed data from low frequency components by performing a frequency domain oversampled transform on the input audio signal by generating asymmetrically windowed, zero-padded samples, and performing a time-to-frequency domain transform on the asymmetrically windowed, zero-padded samples, and subsequently performing a non-linear operation on the output from the time-to-frequency domain transform to generate the transposed data from the low frequency components;

generating two sets of frequency components from the frequency components processed by the non-linear operation by splitting into a first set of frequency components in a first frequency band and a second set of frequency components in a second frequency band; and further performing a first frequency-to-time domain transform on the first set of frequency components and a second frequency-to-time domain transform on the second set of frequency components, wherein each of the first frequency-to-time domain transform and the second frequency-to-time domain transform have transform sizes B times smaller than the time-to-frequency domain transform; and further applying asymmetric zero-padded windows to the samples from the frequency-to-time domain transforms, wherein the asymmetric zero-padded windows are B times shorter than the asymmetrically windowed, zero-padded samples generated from the input audio signal, thus forming two sets of transposed data.

6. The method of claim 5 wherein the first frequency band is the frequency band of CQMF channel 0, and the second frequency band is the frequency band of CQMF channel 1 from a set of CQMF sub-band signals.

7. The method of claim 6 wherein generating a virtual bass signal in response to the transposed data comprises an analysis filter bank applied to one or both of the two sets of transposed data, wherein the analysis filter bank comprises a truncated version of a symmetric filter.

8. The method of claim 7 wherein the analysis filter bank is a Nyquist filter bank and the truncated version of a symmetric filter is a filter where one of the symmetric halves of the filter is removed.

9. The method of claim 8 wherein the analysis filter bank comprises one of an eight-channel Nyquist filter bank or a four-channel Nyquist filter bank, and wherein one of the removed symmetric halves of the filter comprises six coefficients.

10. The method of claim 1 wherein the delayed version of the input audio signal is delayed a pre-defined time period shorter than the latency of the virtual bass signal and the enhanced audio signal is indicative of a time lagged virtual bass signal.

11. The method of claim 10 wherein the pre-defined time period is a value selected from the range of 0 samples to 1000 samples.

12. The method of claim 4 wherein the input audio CQMF channel 0 is received directly from the analysis CQMF bank output of a pre-processing Hybrid filter bank stage, bypassing the Nyquist analysis filter bank of the pre-processing Hybrid filter bank stage.

13. An apparatus for generating low latency virtual bass, comprising:

a first component receiving an input audio signal and performing harmonic transposition on low frequency components of the input audio signal to generate transposed data indicative of harmonics of the input audio signal; and a second component generating a virtual bass signal in response to the transposed data and combining the virtual bass signal with a delayed version of the input audio signal to generate an enhanced audio signal, wherein the harmonic transposition employs combined transposition using a base transposition order B higher than 2 such that the harmonics include a second order harmonic and at least one higher order harmonic of each of the low frequency components, and such that all of the harmonics are generated in response to frequency-domain values determined by a common time-to-frequency domain transform stage using an asymmetric analysis window, and a subsequent inverse transform determined by a common frequency-to-time domain transform stage using an asymmetric synthesis window.

14. The apparatus of claim 13 wherein the base transposition factor B is an integer value selected from the group consisting of: 4, 8, 16 or 32.

15. The apparatus of claim 13 wherein the input audio signal is a sub-band complex-valued quadrature minor filter (CQMF) signal indicative of critically sampled or close to critically sampled low frequency audio from a set of CQMF sub-band signals.

16. The apparatus of claim 15 wherein the critically sampled or close to critically sampled low frequency audio is a CQMF channel 0 signal indicative of the lowest frequency band from a set of CQMF sub-band signals.

17. The apparatus of claim 16 further comprising:

a third component generating transposed data from low frequency components by performing a frequency domain oversampled transform on the input audio signal by generating asymmetrically windowed, zero-padded samples, and performing a time-to-frequency domain transform on the asymmetrically windowed, zero-padded samples, and subsequently performing a non-linear operation on the output from the time-to-frequency domain transform to generate the transposed data from the low frequency components;

a fourth component generating two sets of frequency components from the frequency components processed by the non-linear operation by splitting into a first set of frequency components in a first frequency band and a second set of frequency components in a second frequency band;

a fifth component further performing a first frequency-to-time domain transform on the first set of frequency components and a second frequency-to-time domain transform on the second set of frequency components, wherein each of the first frequency-to-time domain transform and the second frequency-to-time domain transform have transform sizes B times smaller than the time-to-frequency domain transform; and a sixth component applying asymmetric zero-padded windows to the samples from the frequency-to-time domain transforms, wherein the asymmetric zero-padded windows are B times shorter than the asymmetrically windowed, zero-padded samples generated from the input audio signal, thus forming two sets of transposed data.

18. The apparatus of claim 17 wherein the first frequency band is the frequency band of CQMF channel 0, and the second frequency band is the frequency band of CQMF channel 1 from a set of CQMF sub-band signals, and wherein generating a virtual bass signal in response to the transposed data comprises an analysis filter bank applied to one or both of the two sets of transposed data, wherein the analysis filter bank comprise a truncated version of a symmetric filter.

19. The apparatus of claim 18 wherein the analysis filter bank is a Nyquist filter bank and the truncated version of a symmetric filter is a filter where one of the symmetric halves of the filter is removed.

20. The apparatus of claim 19 wherein the analysis filter bank comprises one of an eight-channel Nyquist filter bank or a four-channel Nyquist filter bank, and wherein one of the removed symmetric halves of the filter comprises six coefficients.

21. The apparatus of claim 13 further comprising:

a timing component generating a version of the input audio signal delayed a pre-defined time period shorter than the latency of the virtual bass signal; and a mixing component combining the virtual bass signal with the delayed input audio signal to generate an enhanced audio signal indicative of a time lagged virtual bass signal.

22. The apparatus of claim 16 further comprising an interface component receiving the CQMF channel 0 directly from the analysis CQMF bank output of a pre-processing Hybrid filter bank, bypassing the Nyquist analysis filter bank of the pre-processing Hybrid filter bank stage.

* * * * *